US010717299B1

(12) United States Patent
Pattekar et al.

(10) Patent No.: US 10,717,299 B1
(45) Date of Patent: Jul. 21, 2020

(54) PROCESSING OF COLOR THERMOCHROMIC MATERIALS

(71) Applicant: Palo Alto Research Center Incorporated, Palo Alto, CA (US)

(72) Inventors: Ashish Pattekar, Cupertino, CA (US); Christopher L. Chua, San Jose, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 16/382,884

(22) Filed: Apr. 12, 2019

(51) Int. Cl.

| | |
|---|---|
| ***B41J 2/44*** | (2006.01) |
| ***B41J 2/38*** | (2006.01) |
| ***B41J 2/335*** | (2006.01) |
| ***B41M 5/00*** | (2006.01) |
| ***B41J 11/00*** | (2006.01) |
| ***B41M 5/28*** | (2006.01) |
| ***B41J 2/447*** | (2006.01) |

(52) U.S. Cl.
CPC ..... *B41J 2/442* (2013.01); *B41J 2/3354* (2013.01); *B41J 2/38* (2013.01); *B41J 2/447* (2013.01); *B41J 11/002* (2013.01); *B41M 5/0011* (2013.01); *B41M 5/282* (2013.01)

(58) Field of Classification Search
CPC ... B41J 2/442; B41J 2/3354; B41J 2/38; B41J 2/447; B41J 11/002; B41M 5/0011; B41M 5/282
See application file for complete search history.

(56) References Cited

U.S. PATENT DOCUMENTS

| | | | | |
|---|---|---|---|---|
| 8,842,145 | B2 | 9/2014 | Cridland et al. | |
| 9,475,307 | B2 | 10/2016 | Cridland | |
| 10,583,678 | B1 * | 3/2020 | Pirmoradi | B41J 2/32 |
| 2008/0318154 | A1 | 12/2008 | Wyres | |
| 2012/0104743 | A1 * | 5/2012 | Mehta | B42D 25/29 283/95 |

* cited by examiner

*Primary Examiner* — Lamson D Nguyen
(74) *Attorney, Agent, or Firm* — Mueting Raasch Group

(57) ABSTRACT

An imaging system includes first and second heaters configured to pre-heat a thermochromic coating. The first heater heats at least one of a substrate and the thermochromic coating disposed on the substrate. The second heater heats an ambient environment surrounding the thermochromic coating. The first and second heaters are configured to pre-heat the thermochromic coating to a temperature below a threshold temperature of the thermochromic coating. The system further includes a patterned heater configured to heat the pre-heated thermochromic coating to one or more temperatures above the threshold temperature according to a predetermined pattern.

23 Claims, 7 Drawing Sheets

PROCESSING OF COLOR THERMOCHROMIC MATERIALS

BACKGROUND

Thermochromic materials change color in response to exposure to temperature and light. Thermochromic inks can be applied to relatively larger areas on a substrate by a number of printing or coating processes such as lithography, flexography, gravure, screen printing, spreading with film applicators. After coating or printing the larger areas with the thermochromic material, the areas are exposed to heat and light to produce a color change in precisely controlled regions.

BRIEF SUMMARY

Some embodiments involve an imaging system. The system includes a first heater configured to heat at least one of a substrate and a thermochromic coating disposed on the substrate. A second heater heats an ambient environment surrounding the thermochromic coating. The first and second heaters are configured to pre-heat the thermochromic coating to a temperature below a threshold temperature of the thermochromic coating. Temperatures at or above the threshold temperature cause a color change in the thermochromic coating. Temperatures below the threshold temperature do not cause a discernable color change in the thermochromic coating. The system further includes a patterned heater configured to heat the pre-heated thermochromic coating to one or more temperatures above the threshold temperature according to a predetermined pattern.

Some embodiments are directed to a method of forming a patterned image. The method includes pre-heating at least one of a thermochromic coating and a substrate having the thermochromic coating disposed thereon. The ambient environment surrounding the thermochromic coating is also pre-heated. Preheating the thermochromic coating and/or the substrate and pre-heating the ambient environment causes the thermochromic coating to be pre-heated to a temperature less than a threshold temperature of the thermochromic coating. Temperatures at or above the threshold temperature are needed to cause the thermochromic coating to change color. Temperatures below the threshold temperature do not cause a discernable color change in the thermochromic coating. The pre-heated thermochromic coating is heated to a temperature above the threshold temperature according to a predetermined pattern.

BRIEF DESCRIPTION OF DRAWINGS

The figures are not necessarily to scale. Like numbers used in the figures refer to like components. However, it will be understood that the use of a number to refer to a component in a given figure is not intended to limit the component in another figure labeled with the same number.

DETAILED DESCRIPTION OF ILLUSTRATIVE EMBODIMENTS

Thermochromic materials change color when they are exposed to temperatures above a threshold temperature of the thermochromic material for a period of time. The threshold temperature is a temperature at which a color change is first detectable. A color change with full color saturation can be achieved by exposing the thermochromic material to its saturation temperature (higher than the threshold temperature) for a predetermined time duration. Temperatures between the threshold temperature and the full saturation temperature and/or time duration exposures less than the full duration needed for saturation change the color of the thermochromic material to a color having a saturation that is less than full color saturation. The threshold temperature, saturation temperature, and duration of time needed for color change are characteristics of the particular thermochromic material. For some thermochromic materials, a saturation temperature of about 110 degrees C. causes a color change from colorless to blue at full saturation and the threshold temperature at which no color change is observed may be about 80 degrees C. Types of thermochromic materials useful for the embodiments disclosed herein include diacetylene ethers and homopolymers thereof, and other such materials that exhibit a change in color or darkness upon exposure to heat and/or light, as described, for example, in U.S. Pat. No. 5,149,617 which is incorporated herein by reference.

The approaches disclosed are directed to systems and methods for image formation using thermochromic material. The thermochromic material is first pre-heated to a temperature below the threshold temperature. After or concurrently with the pre-heating of the thermochromic material to the sub-threshold temperature, areas of the thermochromic material are exposed to patterned energy dosages that result in local heating to above the threshold temperature according to a predetermined pattern, e.g., text, images, or other two dimensional graphics.

Figure 1:
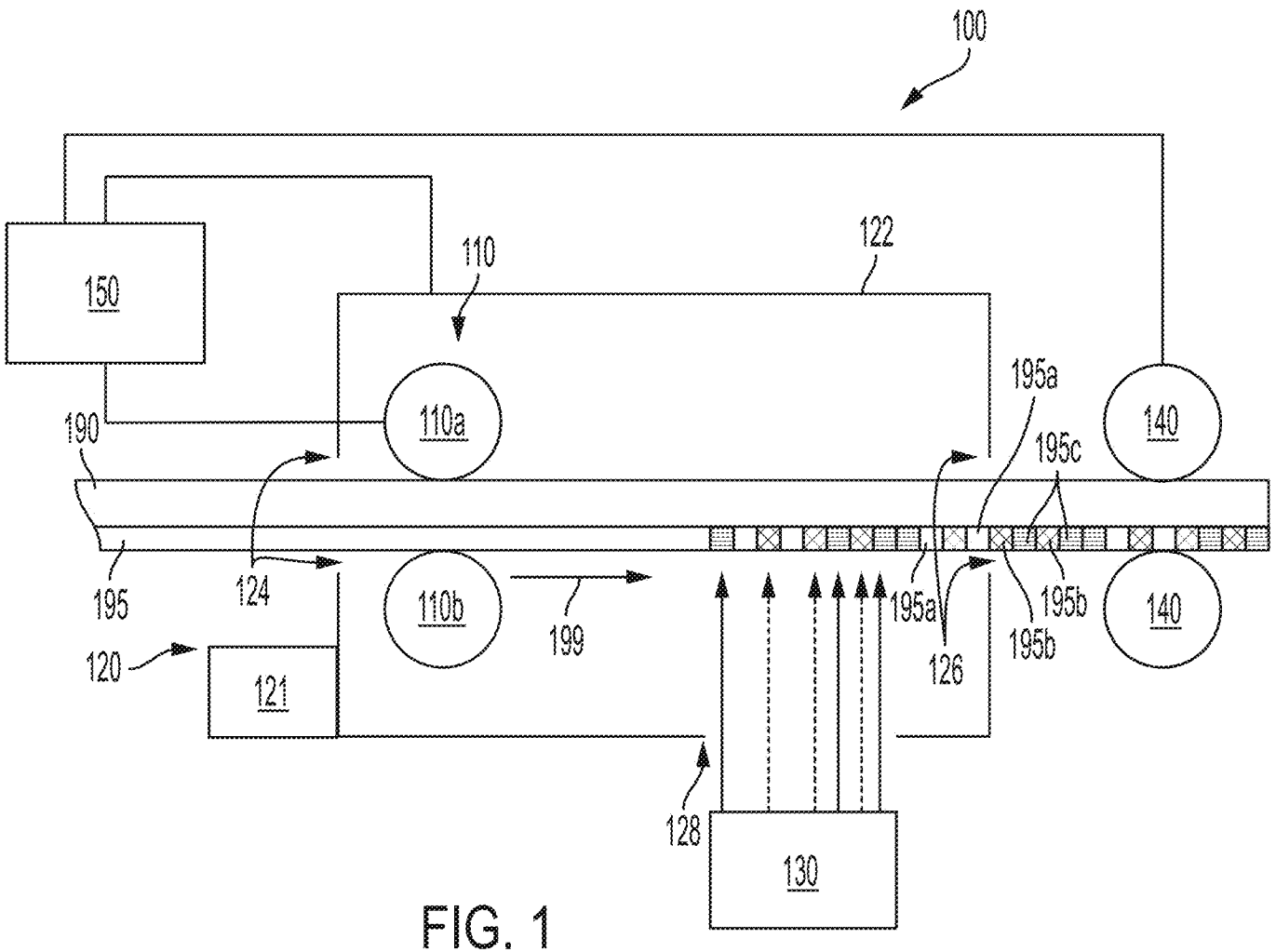
FIG. 1 is a conceptual block diagram of a thermochromic imaging system in accordance with some embodiments.

FIG. 1 is a conceptual block diagram of an imaging system 100 in accordance with some embodiments. The imaging system 100 includes a first heater 110 shown as rollers 110*a*, 110*b* configured to pre-heat at least one of a substrate 190 and a thermochromic coating 195 disposed on the substrate 190. The first heater 110 is typically an unpatterned heater configured to deliver unpatterned heat energy to the substrate 190. The first heater may comprise any contact or non-contact type of heater, including one or more rollers 110*a*, 110*b* as shown in FIG. 1, a radiant heater, a resistive heater, an infrared lamp, etc. The temperature of the heating element of the first heater 110 may exceed the threshold temperature of the thermochromic material. The overall heat transfer from the first heater 110 to the thermochromic coating is maintained at a suitable level by the system in order to ensure that the temperature of the thermochromic coating stays below its threshold temperature.

A second heater 120 is configured to pre-heat the ambient environment surrounding the thermochromic coating 195. As illustrated in FIG. 1, the second heater can include a heat source 121 that heats the air within an enclosure 122. According to some implementations, operation of the first heater 110 and the second heater 120 pre-heats the thermochromic coating 195 to a temperature below the threshold temperature of the coating 195. In this implementation, the thermochromic coating 195 does not exhibit a color change in response to the sub-threshold temperature resulting from the heating effect delivered by the first heater 110 and the second heater 120.

The heater 110 and the ambient heat source 121 may be set to different temperatures or to the same temperature. For example, in some embodiments, the heater 110 comprises a rotating heated drum and the surface of the drum is heated to a first temperature. The ambient heat source 121 may be thermostatically controlled such that the temperatures of the ambient environment is controlled to a second temperature different from, e.g., higher or lower, than the temperature of the heater 110. In some embodiments, the heater 110 may be set to the same temperature as the first heater 120. In various embodiments, one or both of the temperature of the heating element of the first heater 110 and the ambient air temperature produced by the second heater 120 may be within 25%, 20%, 15%, 10%, 5%, or 1% of the threshold temperature of the thermochromic coating 195.

Moreover, the first heater 110 may consist of multiple heating elements. Individual heating elements comprising the first heater 110 may be maintained at different individual temperatures as needed to achieve the target substrate and/or thermochromic coating temperature. The heating rate and temperature of the individual heating elements may be controlled using a closed-loop control system (not shown) that is set up in a manner that the appropriate below-threshold temperature of the thermochromic coating 195 is achieved at the desired speed of movement ("print speed") of the substrate 190 through the imaging system 100.

The second heater 120 may comprise multiple heating elements. Individual heating elements comprising the second heater 120 may be maintained at different individual temperatures as needed to achieve the target thermochromic coating temperature.

In some embodiments, the first and second heaters 110 and 120 may have at least one shared heating element (e.g., a common, shared heat source).

In yet another embodiment, the first and second heaters 110 and 120 may be identical (i.e., a single heater could be used for pre-heating the substrate and/or the thermochromic coating, and also for heating the ambient environment, to the desired temperature(s)).

After or concurrently with the pre-heating of the thermochromic coating 195, a patterned heater 130, e.g., a two-dimensional spatially patterned heat source, is configured to expose selected pixels 195*b*, 195*c* or areas of the pre-heated thermochromic coating to one or more energy dosages. The energy dosages cause the selected pixels 195*b*, 195*c* of the thermochromic coating to further heat up beyond the threshold temperature and elicit a change color according to a predetermined pattern. As indicated in FIG. 1, the thermochromic coating 195 may include multiple pixels 195*a*, 195*b*, 195*c*. The predetermined pattern dictates the pixels that are exposed to an energy dosage from the patterned heat source and/or the amount of energy dosage that each pixel is exposed to. For example, a non-selected set of pixels 195*a* of the thermochromic coating may be not be exposed to an energy dosage above the threshold dosage; a first set of selected pixels 195*b* of the thermochromic coating may be exposed to a first energy dosage above the threshold dosage; a second set of selected pixels 195*c* may be exposed to a second energy dosage above the threshold dosage. The non-selected pixels 195*a* that are not exposed to an energy dosage from the patterned heat source do not heat up above the threshold temperature and thereby remain colorless. The first energy dosage causes the first set of pixels 195*b* to heat up to a temperature above the threshold temperature and change color and attain a first color saturation level. The second energy dosage causes the second set of pixels 195*c* to heat up to a different temperature also above the threshold temperature and thereby change color and attain a second color saturation level. Although this example refers to first and second sets of selected pixels that are exposed to first and second dosages, it will be appreciated that the predetermined pattern may involve more than two sets of pixels that are respectively exposed to different energy dosages and thereby attain more than two different temperatures above the threshold temperature which result in more than two resulting color saturation levels. The patterned heater may include a high intensity light or a laser source patterned using a micro-mirror modulator, or other optical modulator, an array of resistive heaters, and/or an array of heated gas jets, for example. In the context of this patent application, 'light' refers to any electromagnetic radiation in the range of wavelengths ranging from 200 nanometers to 10 micrometers, some or all which may or may not be visible to the human eye. Similarly, 'laser' in the context of this application refers to light that is emitted through a process of optical amplification based on the stimulated emission of electromagnetic radiation ("Light Amplification by Stimulated Emission of Radiation") and may include lasers in the same range of wavelengths from 200 nanometers to 10 micrometers, which may or may not be visible to the human eye.

As shown in FIG. 1, in some embodiments, the substrate 190 comprises an elongated web or film having the thermochromic coating 195 disposed thereon. A movement mechanism 140, illustrated in FIG. 1 as a motor driven pinch roller, moves the elongated substrate 190 through the system. For example, the movement mechanism 140 may move the elongated substrate 190 at print speeds up to about 4 m/s. At these speeds, significant energy demands are placed on the patterned heater 130, e.g., patterned laser source, to keep up with the high-speed patterned heating requirements. Pre-heating using the first and second heaters 110, 120 reduces the energy requirements of the patterned heater 130.

As discussed above, the first heater 110 may comprise at least one rotating heated roller or drum 110*a*, 110*b* that comes in contact or in close proximity with the elongated film 190 as the movement mechanism 140 moves the elongated film 190 along the direction indicated by arrow 199. One or both rollers 110*a*, 110*b* may be heated to any temperature so long as the combined effect of the first and second heaters 110, 120 results in achieving a temperature of the thermochromic coating 195 that is close to, but below the threshold temperature (e.g., by achieving a temperature of the thermochromic coating that is 10° C. below the threshold temperature or even within a range of less than 5° C. below the threshold temperature). For example, in some configurations the heated roller 110*a* may be heated to a temperature higher than the threshold temperature of the thermochromic coating 195. However, the movement of the film 190 is controlled such that dwell time of the thermochromic coating 195 over the heated roller 110*a* is brief and thus the thermochromic coating 195 is not heated to above the threshold temperature.

The enclosure 122 of the second heater 120 includes an entrance opening 124 that allows the elongated film 190 to enter the enclosure 122 and an exit opening 126 that allows the elongated film 190 to exit the enclosure 122. The movement mechanism 140 moves the substrate 190 having the thermochromic coating 195 disposed thereon into and out of the enclosure 122 through the entrance and exit openings 124, 126.

When an enclosure is used, the patterned heater 130 may be located outside or inside the enclosure. FIG. 1 shows the patterned laser source 130 located outside the enclosure 122. An optically transmissive window 128 transmits light from the laser source 130 into the enclosure 122 to heat the thermochromic coating 195.

According to some aspects, system 100 includes a controller 150 that controls and coordinates the operation of the first heater 110, the second heater 120, the patterned heater 130, and the movement mechanism 140.

Figure 2A:
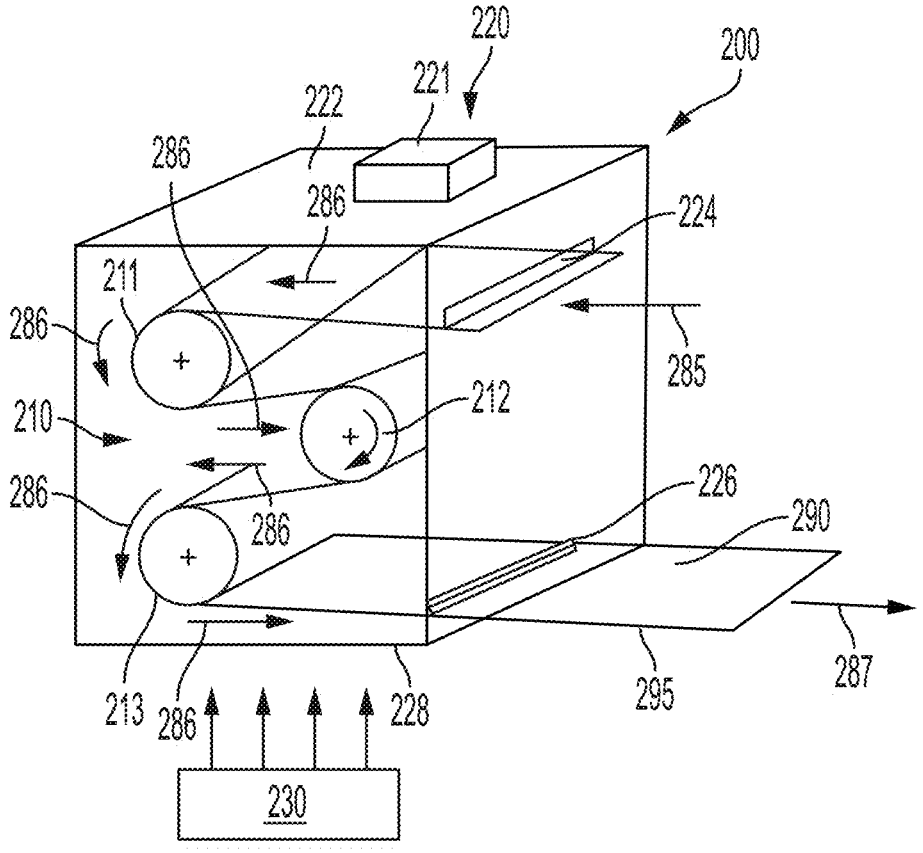
FIG. 2A is a diagram illustrating a portion of a thermochromic imaging system including an enclosure in accordance with some embodiments.

FIG. 2A is a diagram illustrating a portion of a thermochromic imaging system 200 in accordance with some embodiments. System 200 comprises an enclosure 222 having input and exit openings 224, 226 on the same side of the enclosure 222. The substrate is configured as an elongated film 290. A movement mechanism, not shown in FIG. 2A, moves the elongated film 290 having the thermochromic coating 295 disposed thereon into the enclosure 222 through the entrance opening 224 along arrow 285. The substrate 290 moves over three tensioning rollers 211, 212, 213 disposed within the enclosure 222 along the directions indicated by arrows 286. The elongated film 290 exits the enclosure 222 through exit opening 226 along the direction of arrow 287. At least one of the rollers 211, 212, 213 within the enclosure 222 functions as the first heater 210. The second heater 220 comprises an ambient heat source 221 that heats the ambient environment, e.g., air, inside the enclosure 222.

Figure 2B:
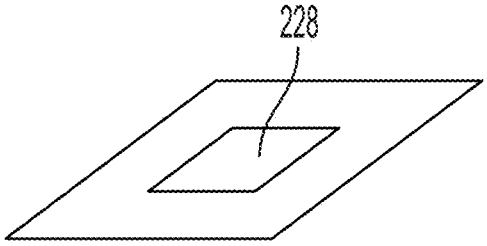
FIG. 2B illustrates an optically transmissive window that allows patterned laser light to enter the enclosure of the system of FIG. 2A.

One or both of entrance opening 224 and exit opening 226 may include at least one air exchange feature that reduces air exchange between the outside and the inside of the enclosure 222. The air exchange feature may comprise one or more of a roller, a brush, a fabric, and an elastomer. A patterned heater 230 comprising a spatially patterned laser source is disposed outside the enclosure 222. As depicted in FIGS. 2A and 2B, the enclosure 222 includes an optically transmissive window 228 that transmits the laser light from the source 230 into the enclosure 222. The optically transmissive window 228 may include an antireflective coating to reduce reflections at the interface between the outside environment, e.g., air, and the window material, e.g., glass.

Figure 3:
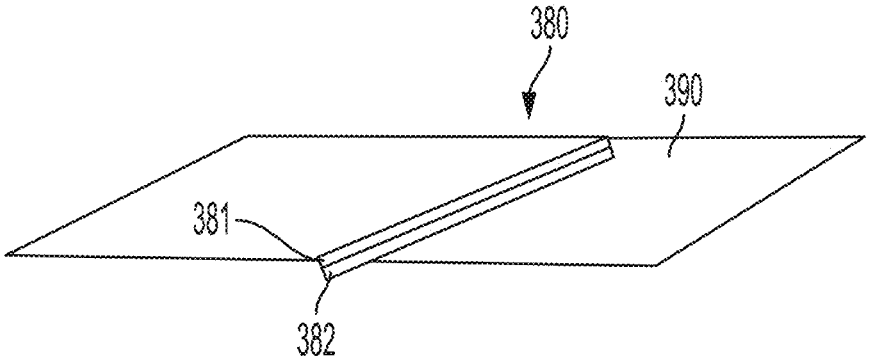
FIG. 3 illustrates an air exchange feature comprising brushes that may be arranged at the top and/or bottom of the entrance and/or exit opening of the enclosure of a thermochromic imaging system in accordance with some embodiments.

FIG. 3 illustrates an air exchange feature 380 comprising brushes 381, 382 that may be arranged at the top and/or bottom of the entrance and/or exit opening 224, 226 of the enclosure 222. The elongated film 390 moves between the brushes 381, 382 as it enters or exits the enclosure 222. The brushes 381, 382 are configured to reduce air exchange between the interior and the exterior of the enclosure 222, by breaking up the boundary layer of ambient air that may otherwise get introduced into the enclosure 222 along with the moving elongated film 390 as it enters the enclosure 222.

Figure 4:
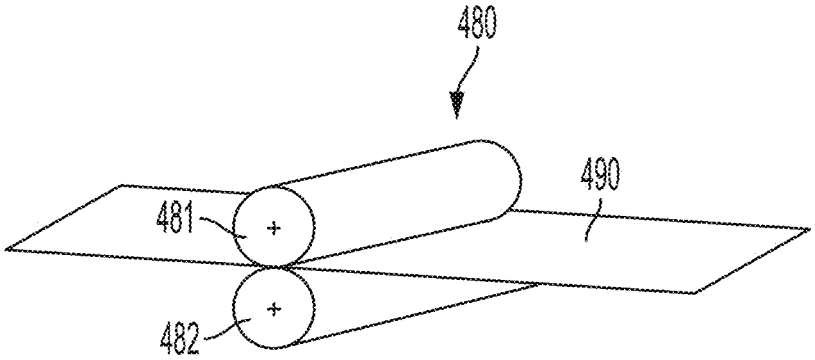
FIG. 4 illustrates an air exchange feature comprising rollers that may be arranged at the top and/or bottom of the entrance and/or exit opening of the enclosure of a thermochromic imaging system in accordance with some embodiments.

FIG. 4 illustrates an air exchange feature 480 comprising rollers 481, 482 that may be arranged at the top and/or bottom of the entrance and/or exit opening 224, 226 of the enclosure 222. The elongated film 490 moves between the rollers 481, 482 as it enters or exits the enclosure 222. The rollers 481, 482 are configured to reduce air exchange between the interior and the exterior of the enclosure 222 by pinching off any air flow that may accompany the elongated film 490 as it enters the enclosure 222.

Figure 5:
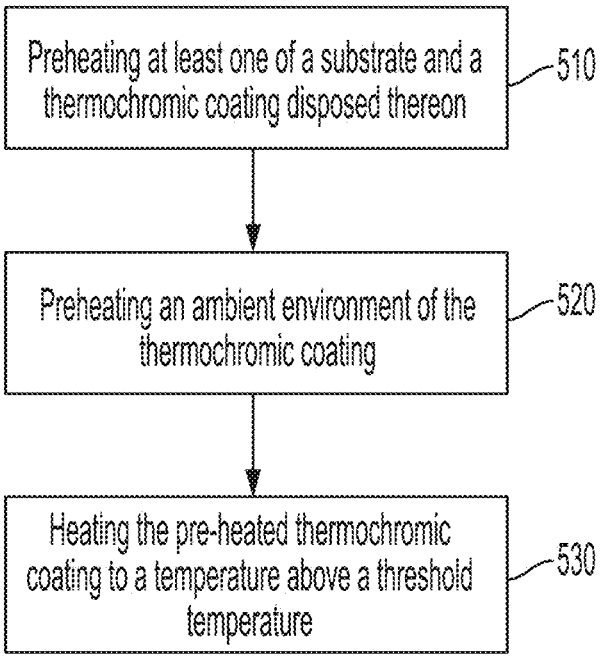
FIG. 5 is a flow diagram of a method of thermochromic imaging in accordance with some embodiments.

FIG. 5 is a flow diagram illustrating a thermochromic image formation method in accordance with some embodiments. The method includes pre-heating 510 a substrate having a thermochromic coating disposed thereon and pre-heating 520 an ambient environment surrounding the thermochromic coating. Pre-heating the substrate and the ambient environment pre-heats the thermochromic coating to a temperature that is insufficient to produce a detectable color change. After or during the pre-heating, the thermochromic coating is heated 530 above the threshold temperature according to a predetermined pattern. The thermochromic coating may be pattern-wise heated above the threshold temperature using a spatially patterned light or laser source, a two dimensional array of resistive (electrical) heaters, and/or a two-dimensional array of heated gas jets, for example.

According to some implementations pre-heating the substrate comprises bringing the substrate near or in contact with a heated rotating drum. Pre-heating the ambient environment surrounding the thermochromic coating comprises moving the substrate having the thermochromic coating disposed thereon into and out of an enclosure while pre-heating the ambient environment within the enclosure. Moving the substrate into and out of the enclosure can involve moving the substrate through at least one air control feature that reduces air exchange between outside and inside of the enclosure.

As discussed herein, thermochromic coatings that exhibit a threshold temperature for development and a higher full saturation temperature can mitigate energy demand on the digital printing system (e.g., using a patterned laser source) by pre-heating the substrate and the environment to just below the threshold temperature. From an energy point of view, if the energy density to get to the threshold state is X (Joule/$cm^2$) and the total energy density to get to full saturation development is Y (Joule/$cm^2$), the fractional energy savings for the patterned portion by preheating the substrate to just below threshold might be expected to be at most X/(X+Y) (Joule/cm2).

However, using the preheated substrate and heated ambient reduces energy demand on the patterned heater more than what is expected by the above calculation. Due to the thermal penetration into the substrate thickness as well as the reduction in the heat loss due to the heated ambient, an additional energy savings, e.g., about 25% energy savings, is possible on top of the X/(X+Y) savings, thus reducing the overall demand on the patterned portion of the imaging system, e.g., laser power requirements, and enabling a more efficient and cost-effective operation.

Figure 6:
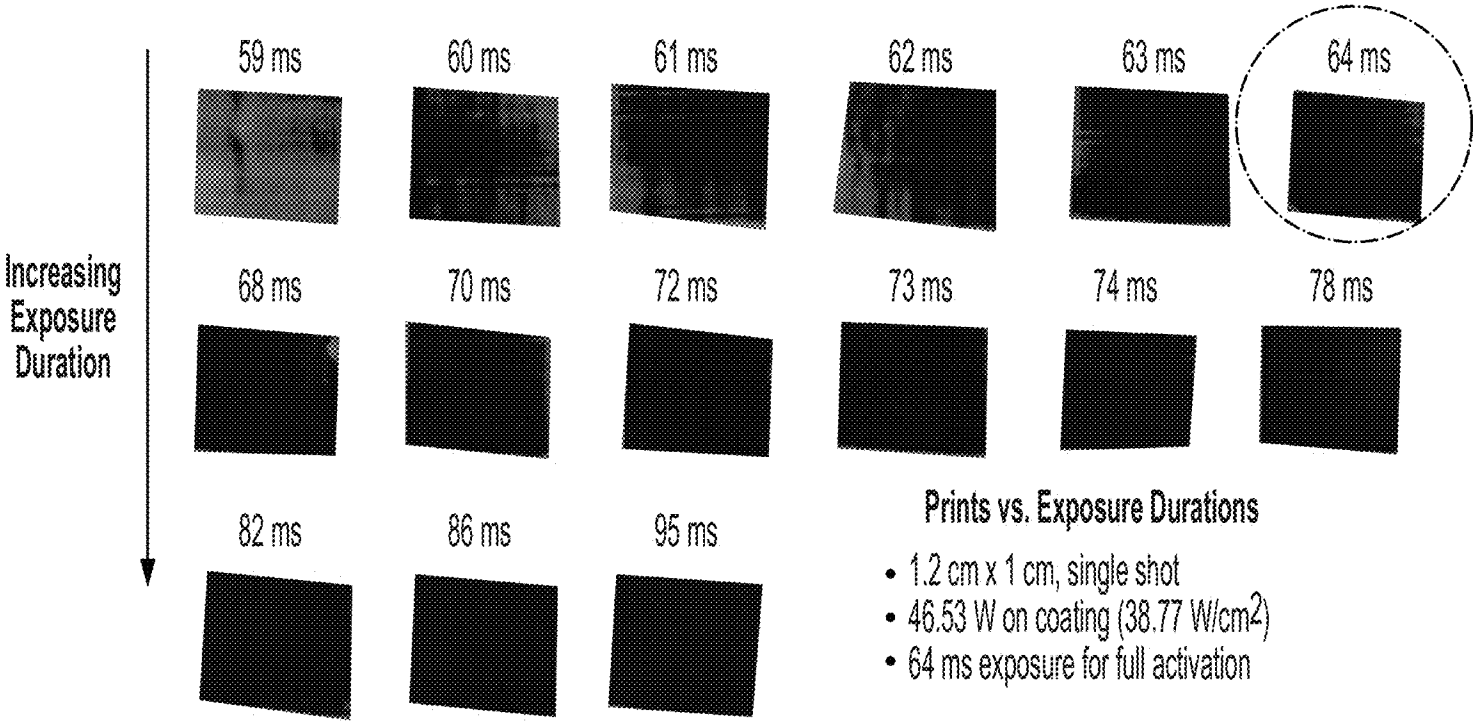
FIG. 6 shows color saturation of samples after heating above the saturation temperature for different time durations.

Ambient and substrate preheating was tested in various simulations and experiments. In one experiment, fifteen samples were prepared by coating substrates with 1.2 cm×1 cm areas of the same type thermochromic material. Each sample was exposed to a different laser dosage to determine the time duration needed for full saturation. The laser exposures were performed with a room temperature (unheated) ambient and a room temperature (unheated) substrate. The measured laser power was 46.53 Watt (38.77 Watt/cm$^2$) on the substrate; the measurement included the overall effect of all optical losses in the laser projection system. The samples after laser exposure are shown in FIG. 6. From this experiment it was determined that an exposure time duration of 64 ms was needed to achieve full development saturation for this material.

Based on the operating conditions for this test, the projected print speed (v_print) would be 10 mm/64 ms=0.15625 m/s, assuming zero dead-time between successive exposures.

A thermal model was developed using COMSOL simulation software. The thermal model included the effect of the heating due to the laser illumination, the heat transfer into the substrate thickness and heat loss to the (room temperature) ambient environment.

Figure 7:
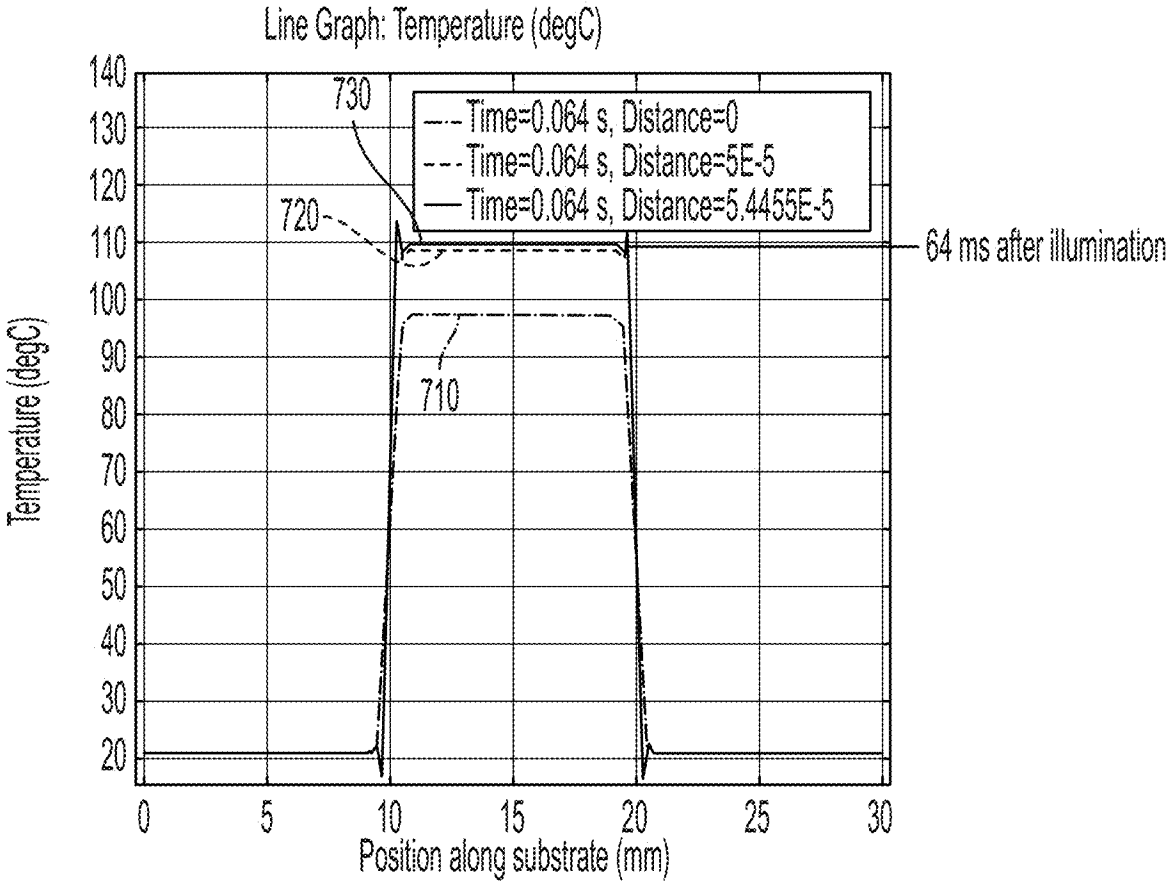
FIG. 7 shows graphs of the temperature rise vs. position at 64 ms after illumination by the laser calculated by a model without ambient or substrate heating.

Using measured values of thermal conductivity and heat capacity of the substrate and coating, the expected temperature change of the coating was calculated through the model simulations. Initially the model was compared with the experimental data previously discussed. FIG. 7 shows graphs of the temperature rise vs. position at 64 ms after illumination by the laser calculated by the model without ambient or substrate heating. Graph 710 shows the temperature rise vs. position at 64 ms exposure taken at the substrate backside; graph 720 shows the temperature rise vs. position at 64 ms exposure taken at the substrate-coating interface; and graph 730 shows the temperature rise vs. position at 64 ms exposure taken at the top surface. The model predicted a temperature rise to 110 degrees C. in 64 ms consistent with the experimentally observed exposure time to achieve saturation. This simulation enabled the validation of the thermal model and verification of the accuracy of projections, which can be used to model expected improvements in performance, e.g., by using higher laser power beyond current experimental capability and also other improvements such as preheating the substrate as well as ambient environment to improve print speed for a given laser power.

Figure 8:
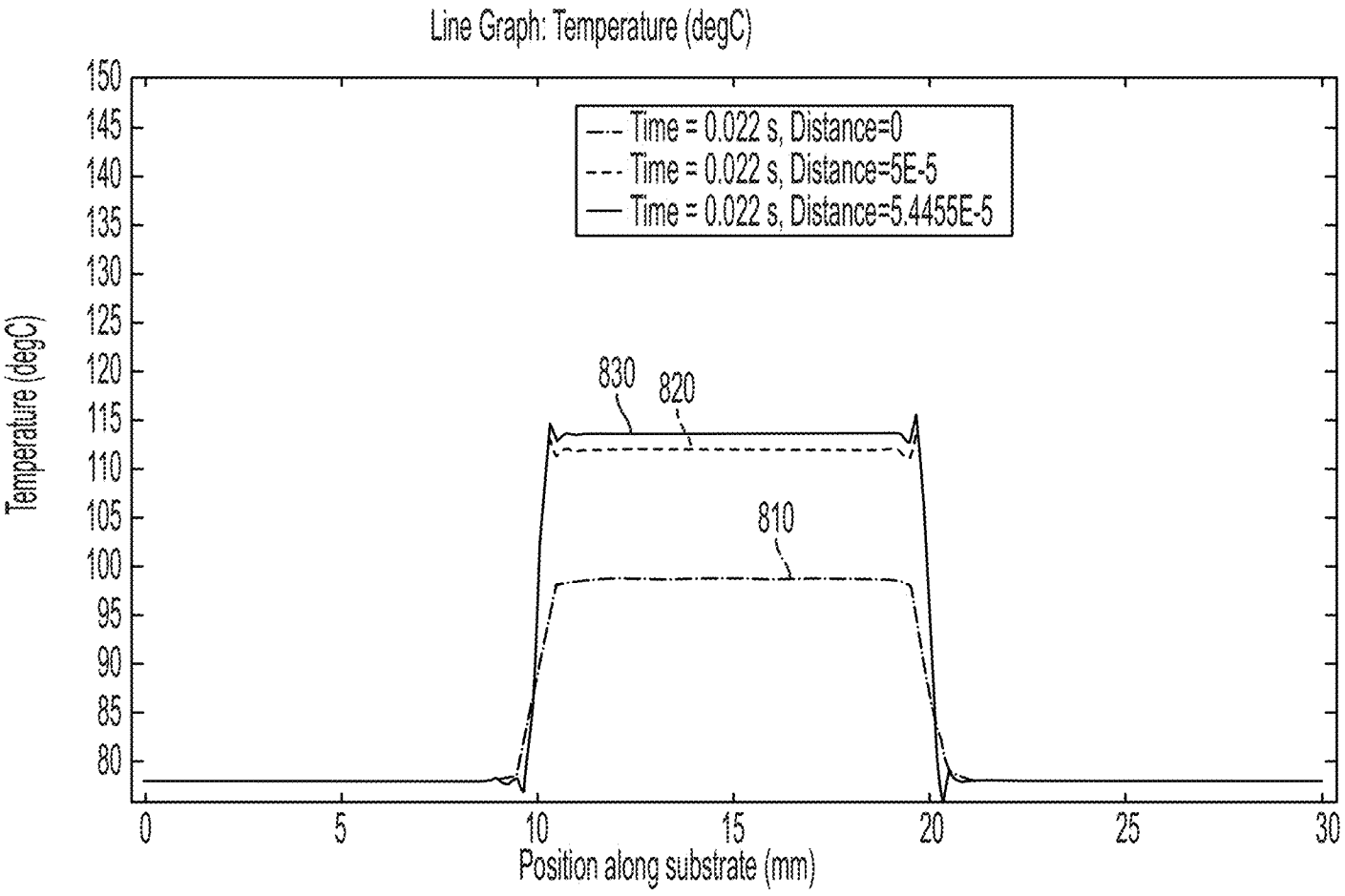
FIG. 8 shows graphs of the temperature rise vs. position at 22 ms after illumination by the laser calculated by a model with ambient and substrate heating.

Using the validated thermal model, we then simulated the effect of using a preheated substrate that is heated to 78 C (just below T_threshold=80 degrees C.) and also using a locally heated ambient environment (surrounding air) that is maintained at 78 C. Using the preheated substrate and ambient at 78 C, the model predicted that an exposure of 21-22 ms would be sufficient to achieve a 110 C target temperature of the coating as illustrated in the graphs of FIG. 8. In FIG. 8, graph 810 shows the temperature rise vs. position at 22 ms exposure taken at the substrate backside; graph 820 shows the temperature rise vs. position at 22 ms exposure taken at the substrate-coating interface; and graph 830 shows the temperature rise vs. position at 22 ms exposure taken at the top surface.

Thus the thermal modeling predicted a potential 'digital' energy reduction of (64−22)/64=65% when using an ambient preheat with preheated substrate (both to 78 C, i.e., just below T_threshold of 80 C). Digital energy reduction refers to the reduction in energy of the patterned heating.

We next performed experiments to test ambient and substrate preheating. Samples were placed in an enclosure with an optically transmissive window with antireflective (AR) coating. The ambient temperature within the enclosure was heated to 78 degrees C. and the substrate was heated to 78 degrees C. Light from a patterned laser source was projected through the optically transmissive window to expose the thermochromic material.

We found that with the additional optical losses with the cover glass (despite the AR coating), the 'no preheat' exposure time was 68 ms for close to full development, 4 ms higher than earlier 'no cover glass' experiments. Then, by turning on the first and second heaters to maintain the temperature of the coating and substrate at 78 degrees C. we found that an exposure of about 28 ms was sufficient to achieve near-complete development.

Thus the experimental results confirm the improvement of the print process performance using ambient and substrate preheating. Specifically, we observed a 'digital' energy requirement reduction of (68−28)/68=59% when using an ambient preheat with preheated substrate with the substrate and local environment (air) preheated to 78 degrees C., which was just below T_threshold of 80 C for the thermochromic material. This 59% reduction compares well with the theoretically projected 65% reduction from the modeling results described earlier. Possible reasons for the 6% difference may be related to inefficient heating of the environment in the cavity defined by the experimental fixture comprising a copper block and cover glass (heating only from copper side) and other experimental factors which are not included in the idealized theoretical model.

In previous experiments when determining the development characteristic curve for this coating, it was demonstrated that up to 46% of the total energy requirement for development of the thermochromic material could be provided as 'non-digital' (i.e., non-modulated, constant on) heating, e.g., heating by an unmodulated laser source, and 54% of the energy would need to be digital. e.g., heating by patterned laser source. Thus the coating development characteristic curve points to a potential modulated (digital) energy reduction of about 46% by using an additional 'preheat' heat source, which would indicate that the exposure time of 68 ms would be expected to go down to about 36.7 ms (=54% of 68 ms).

Thus, the model predicted/experimentally demonstrated 22 ms-28 ms exposure represents about a 25% to 30% improvement in digital printing energy requirement using ambient preheat and preheated substrate, versus using a preheat via unmodulated laser or other radiant preheat approach.

The embodiments disclosed herein provide for 1) lower heat loss to surrounding air at 78 degrees C. compared to 21 degrees C. for room temperature printing; and 2) lower heat loss into the substrate thickness as the substrate has equilibrated to 78 degrees C. by the time modulated/patterned laser exposure occurs, rather than starting out at room temperature (21 degrees C.). The above two effects together result in reduction of the patterned energy requirement for a thermochromic imaging system beyond what would be possible by using optical (laser/radiant) preheat alone.

Various modifications and alterations of the embodiments discussed above will be apparent to those skilled in the art, and it should be understood that this disclosure is not limited to the illustrative embodiments set forth herein. The reader should assume that features of one disclosed embodiment can also be applied to all other disclosed embodiments unless otherwise indicated. It should also be understood that all U.S. patents, patent applications, patent application publications, and other patent and non-patent documents referred to herein are incorporated by reference, to the extent they do not contradict the foregoing disclosure.

The invention claimed is:

1. A system comprising:

a first heater configured to heat at least one of a substrate and a thermochromic coating disposed on the substrate;

a second heater configured to heat an ambient environment surrounding the thermochromic coating, the first and second heaters configured to pre-heat the thermochromic coating to a temperature below a threshold temperature of the thermochromic coating, temperatures at or above the threshold temperature causing a color change in the thermochromic coating; and a patterned heater configured to heat the pre-heated thermochromic coating to one or more temperatures above the threshold temperature according to a predetermined pattern.

2. The system of claim 1, wherein:

the first heater is configured to heat at least one of the substrate and the thermochromic coating to a first temperature; and the second heater is configured to heat the ambient environment surrounding the thermochromic coating to a second temperature different from the first temperature.

3. The system of claim 1, wherein:

the first heater is configured to heat at least one of the substrate and the thermochromic coating to a first temperature;

the second heater is configured to heat the ambient environment surrounding the thermochromic coating to a second temperature; and the first temperature is substantially equal to the second temperature.

4. The system of claim 1, wherein:

the first heater is configured to heat the thermochromic coating to a first temperature;

the second heater configured to heat the ambient environment surrounding the thermochromic coating to a second temperature; and one or both of the first temperature and the second temperature is within 25% of the threshold temperature.

5. The system of claim 1, wherein the first heater is heated to a temperature above the threshold temperature of the thermochromic coting.

6. The system of claim 1, wherein the first heater comprises one or more of a rotating heated drum, an infrared heater, and a resistive heater.

7. The system of claim 1, wherein:

the substrate comprises an elongated film;

the first heater comprises a rotating drum that comes in contact with the elongated film and the rotating drum is heated to a temperature above the threshold temperature; and further comprising a movement mechanism configured to move the elongated film at a speed sufficient to heat the thermochromic coating to a temperature less than the threshold temperature.

8. The system of claim 1, wherein the patterned heater comprises at least one of a laser, a resistive heater, and an array of heated gas jets.

9. The system of claim 1, wherein the second heater comprises a heat source and an enclosure that at least partially encloses the thermochromic coating.

10. The system of claim 9, wherein:

the substrate comprises an elongated film;

the enclosure includes an entrance opening that allows the elongated film to enter the enclosure and an exit opening that allows the elongated film to exit the enclosure;

further comprising a movement mechanism configured to move the substrate having the thermochromic coating disposed thereon into and out of the enclosure.

11. The system of claim 10, wherein one or both of the entrance opening and exit opening includes at least one feature that reduces air exchange between outside and inside of the chamber.

12. The system of claim 11, wherein the feature comprises at least one of a roller, a brush, a fabric, and an elastomer.

13. The system of claim 10, wherein:

the patterned heater comprises a laser; and the enclosure includes an optically transmissive window configured to allow light from the laser to enter the enclosure and heat the thermochromic coating.

14. The system of claim 1, wherein the first and second heaters comprise at least one shared heating element.

15. The system of claim 1, wherein the first and second heaters are identical.

16. The system of claim 1, wherein the thermochromic material comprises diacetylene ethers and homopolymers thereof.

17. A method, comprising:

pre-heating a substrate having a thermochromic coating disposed thereon;

pre-heating an ambient environment surrounding the thermochromic coating, pre-heating the substrate and the ambient environment pre-heats the thermochromic coating to a temperature less than a threshold temperature of the thermochromic coating, temperatures at or above the threshold temperature causing the thermochromic coating to change color; and heating the pre-heated thermochromic coating above the threshold temperature according to a predetermined pattern.

18. The method of claim 17, wherein pre-heating the substrate comprises bringing the substrate near or in contact with a heated rotating drum.

19. The method of claim 17, wherein heating the pre-heated thermochromic coating above the threshold temperature according to the predetermined pattern comprises heating the pre-heated thermochromic coating using at least one of a spatially patterned laser source, an array of resistive heaters, and an array of heated gas jets.

20. The method of claim 17, wherein pre-heating the ambient environment surrounding the thermochromic coating comprises:

moving the thermochromic coating into and out of an enclosure; and heating the ambient environment within the enclosure.

21. The method of claim 20, wherein heating the pre-heated thermochromic coating comprises directing laser light through an optically transmissive window configured to allow light from the laser to enter the enclosure and heat the thermochromic coating.

22. The method of claim 20, wherein moving the thermochromic coating into and out of the enclosure comprises moving the thermochromic coating through at least one air control feature that reduces air exchange between outside and inside of the enclosure.

23. The method of claim 22, wherein the air control feature comprises at least one of a roller, a brush, a fabric, and an elastomer.

* * * * *